United States Patent [19]

Vanderloop

[11] 4,271,632

[45] Jun. 9, 1981

[54] SILO DOOR

[76] Inventor: James P. Vanderloop, Rte. #4, Kaukauna, Wis. 54130

[21] Appl. No.: 105,941

[22] Filed: Dec. 20, 1979

[51] Int. Cl.[3] ..... E05D 15/52

[52] U.S. Cl. ..... 49/192; 49/255; 49/261; 49/191; 52/192; 52/196

[58] Field of Search ..... 49/192, 255, 253, 261, 49/153, 154, 158, 191, 247; 52/192, 196, 208, 193

[56] References Cited

U.S. PATENT DOCUMENTS

| | | | |
|---|---|---|---|
| 1,126,653 | 1/1915 | Pascoe | 49/253 X |
| 1,130,307 | 3/1915 | MacCallum et al. | 49/253 |
| 1,162,022 | 11/1915 | Brandenburg | 49/253 |
| 3,997,025 | 12/1976 | Price | 49/153 |

*Primary Examiner*—Kenneth Downey

*Attorney, Agent, or Firm*—Zarley, McKee, Thomte, Voorhees & Sease

[57] ABSTRACT

The silo door of the present invention is adapted to fit in closing relation over an opening in the silo wall. The door is connected to the silo by a hinge which permits the door to swing about a vertical axis located adjacent one of the vertical side edges of the opening. A bracket connects the hinge to the door and permits inward tilting movement of the door with respect to the hinge about a horizontal tilt axis. A latch is provided for selectively detachably securing the door to the silo in rigid covering relationship over the opening.

11 Claims, 6 Drawing Figures

SILO DOOR

BACKGROUND OF THE INVENTION

This invention relates to silo doors and particularly to a plurality of silo doors which may be vertically aligned and individually removable one at a time.

Silos often include a vertically oriented elongated opening in one of the side walls thereof. This elongated opening is provided with a plurality of vertically aligned doors, each of which may be removed one at a time, commencing from the top and progressing downwardly as the silo is emptied.

Several problems are encountered with the present silo doors. One problem is the interference of the silo door with the rotating auger on the interior of the silo. Many present silo doors protrude inwardly beyond the inner cylindrical surfaces of the silo, and consequently they interfere with the rotating auger which is adapted to carry the contents of the silo to the door opening.

Another problem encountered with present silo doors is the tendency of these doors to become stuck or jammed in the opening due to the exposure of the door to the contents of the silo, as well as due to expansion and contraction of the various parts. Oftentimes it is difficult to remove the door because it has become jammed or stuck in the opening.

SUMMARY OF THE INVENTION

The present invention contemplates a door which can be easily removed from the door opening. The door is mounted in the opening and is pivotally connected to a pair of hinge arms which in turn are pivotally connected to a vertical hinge axis located adjacent the edge of the door. A bracket connects the door to the hinge arms, and permits the door to move with respect to the hinge arms about a horizontal axis. Similarly, the bracket permits the doors to move about a vertical axis with respect to the hinge arms.

In opening the door, the operator merely needs to release a latch holding the door in place and to force the door inwardly so that it tilts about a horizontal axis located adjacent the lower edge thereof. Once the upper edge of the door is tilted inwardly, the door is then swung inwardly about the vertical axis provided by the hinge arms.

Another feature of the door is the ability of the hinge to slide vertically upwardly about its hinge axis so as to permit the disengagement of foot brackets adjacent the bottom edge of the door from the bottom edge of the door opening. Thus, by lifting the hinge arms vertically upwardly, the operator can free the foot brackets from engagement with the bottom edge of the door opening, thereby freeing the door to swing inwardly about the vertical axis provided by the hinge arms.

Another feature of the present invention is the provision of a curved inner surface which conforms to the inner cylindrical surface of the silo. When the door is in place over the silo opening, the inner surface of the door forms a smooth continuation of the arcuate surface on the interior of the silo, and therefore does not present any inwardly extending protuberances which would interfere with the augers or equipment within the silo.

Therefore, a primary object of the present invention is the provision of an improved silo door.

A further object of the present invention is the provision of an improved silo door which permits inward tilting of the door before swinging the door inwardly about a vertical axis.

A further object of the present invention is the provision of a device which improves the ease with which the door can be freed if stuck in the opening.

A further object of the present invention is the provision of a device which includes an arcuate inner surface forming a smooth continuation of the curvature of the inner surface of the silo.

A further object of the present invention is the provision of a device which minimizes interference with a rotating auger or other equipment within the silo.

A further object of the present invention is the provision of means for mounting the door within the opening so as to permit four separate types of movement: vertical displacement of the door to free the foot brackets from the bottom edge of the door opening; tilting action of the door about a horizontal axis to free the upper edge of the door from the door opening; pivotal movement of the door about a first axis adjacent the edge of the door opening so as to permit the door to be moved away from the door opening; and pivotal movement of the door about a second vertical axis between the hinge arms and the door.

A further object of the present invention is the provision of silo doors which can be interlocked to one another in vertical alignment.

A further object of the present invention is the provision of silo doors which can be removed one at a time in an easier fashion than previously known.

A further object of the present invention is the provision of a silo door which is durable, economical and simple in construction.

DETAILED DESCRIPTION

Figure 1:
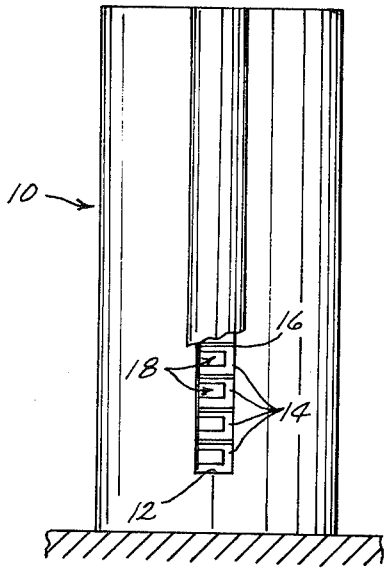
FIG. 1 is a plan view of a silo having a vertical opening therein.

Referring to the drawings, the numeral 10 designates a silo having an elongated vertical opening 12 therein. Opening 12 is separated into a plurality of vertically aligned door openings 14 by means of a plurality of spaced apart stationary cross bars 16 which may be round or rectangular in cross section.

Figure 3:
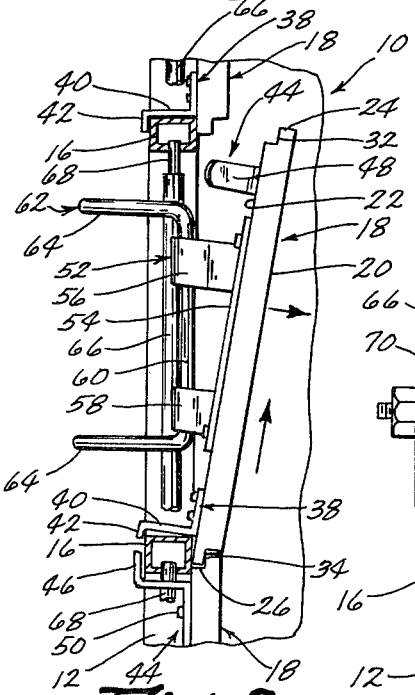
FIG. 3 is a side elevational view of the door, showing the door tilted inwardly about its tilt axis.
Figure 5:
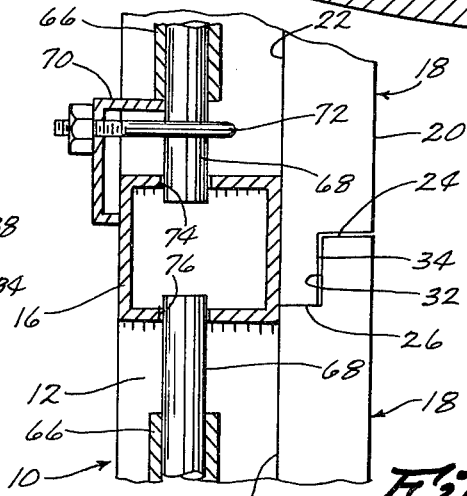
FIG. 5 is a sectional view taken along line 5—5 of FIG. 2.

Mounted over each door opening 14 is a silo door 18. Each silo door 18 is rectangular in shape and includes an inner arcuate surface 20, an outer planar surface 22, an upper edge 24, a lower edge 26, and opposite side edges 28, 30. Upper side edge 28 is provided with a rabbit groove 32 and lower side edge 26 is provided with a reverse rabbit groove 34 adapted to matingly receive the rabbit groove 32, so that a plurality of doors 18 may be locked together in vertical alignment as shown in FIGS. 3 and 5. Use of rabbit groove is optional. These grooves can be omitted, without detracting from the invention.

Figure 4:
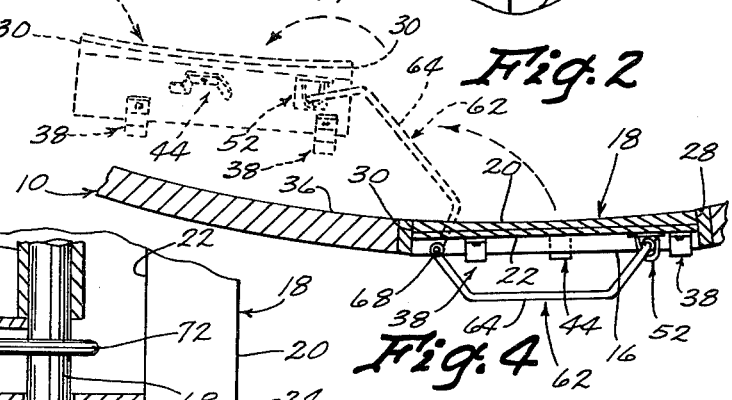
FIG. 4 is a top plan view of the door showing the door in its latched position in solid lines, and showing the door swung inwardly in phantom lines.

Each door 18 is sized to fit over each door opening 12 in closing relation so that the inner arcuate surface 20 of door 18 forms a continuation of the inner arcuate surfaces 36 of the silo 10 as is shown in FIG. 4. Thus, door 20 does not provide any protuberances extending inwardly within the silo to interfere with the unloading equipment therein.

Mounted to the outer surface 22 of door 18 adjacent the lower edge thereof are a pair of foot brackets 38 each of which includes an outwardly extending horizontal portion 40 and a downwardly extending lip 42 which retentively engages cross bar 16. The upper edge of door 18 is connected to another cross bar 16 by means of a latch 44 which includes a lip 46 for engaging cross bar 18 and a handle 48 for permitting the pivotal movement of latch 44 about an axis 50 so as to move lip 48 into and out of retentive engagement with cross bar 16.

A tilt bracket 52 is rigidly mounted to the outer surface 22 of door 18 and includes a plate 54 secured in facing engagement with the outer surface 22. A pair of U-shaped cuffs 56, 58 are secured to plate 54 and are in vertical registered alignment with one another. Cuff 56 is slightly bigger than cuff 58 and extends a slightly greater distance away from surface 22 than does cuff 58.

Extending through the vertically aligned cuffs 56, 58 is a vertical leg 60 of a ladder bar assembly 62. Ladder bar assembly 62 comprises a pair of U-shaped horizontal bars 64, vertical leg 60, and a vertical sleeve 66. Vertical sleeve 66 is rotatably and slidably mounted over a stationary vertical shaft 68 which serves as a hinge axis for ladder bar assembly 62 and which also serves as a vertical sliding guide for sleeve 66 and ladder bar assembly 62.

Vertical shaft 68 is stationary with respect to silo 10, and this stationary securement is provided by a U-shaped bracket 70 (FIG. 5) having a J-bolt 72 hooked around the lower end of shaft 68. The extreme lower end of shaft 68 protrudes within an opening 74 in cross bar 16. Tightening of J-bolt 72 causes shaft 68 to be held rigidly against movement within opening 74. The upper end of shaft 68 is fitted within an opening 76 of cross bar 16.

Figure 2:
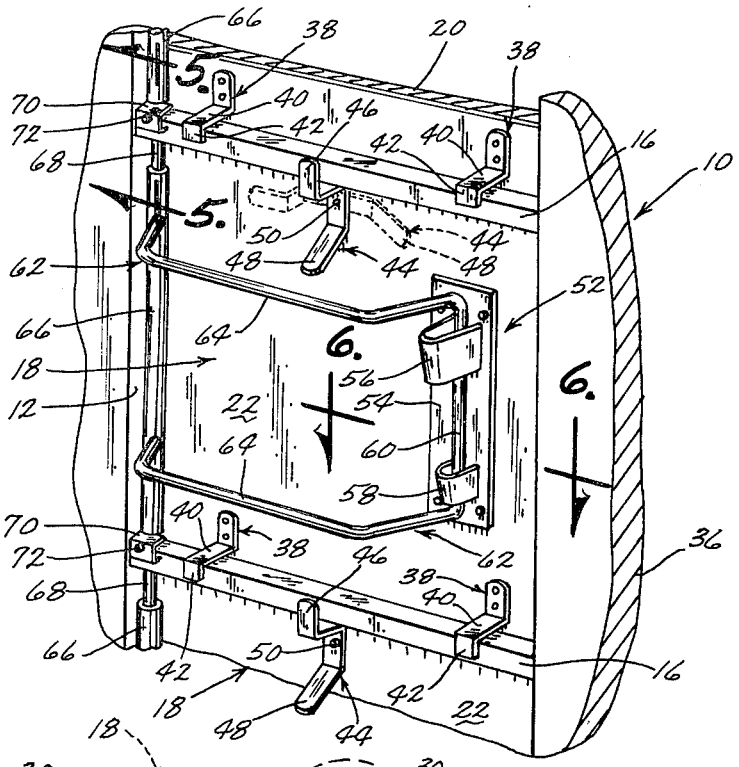
FIG. 2 is a detailed perspective view of one door mounted within the silo walls.

In operation, the door is latched in place as shown in FIG. 2. When it is desired to remove one of the doors, latch 44 is rotated so that lip 48 is out of retentive engagement with cross bar 16. Door 18 is then tilted inwardly about a tilt axis 76 (FIG. 3) which is located adjacent the lower edge of door 18. Lips 42 of foot brackets 38 hold the lower edge of door 18 against movement inwardly so as to facilitate the tilting action. U-shaped cuffs 56, 58 permit the tilting movement of door 18 to the position shown in FIG. 3, but limit the door against any further tilting action.

The next step in removing the door from the opening is to lift manually upwardly on ladder bar assembly 62 so as to slide sleeve 66 vertically upwardly on shaft 68. This lifts the entire door 18, thereby lifting lips 42 vertically upwardly so that they clear cross bar 16 and permit further inward movement of door 18 with respect to the silo walls. The door then swings inwardly about the pivotal axis provided by shaft 68 to the position shown in shadow lines in FIG. 4. Furthermore, door 18 is free to pivot about the pivotal axis provided by cuffs 56, 58 which surround vertical legs 60 of ladder assembly 62.

Figure 6:
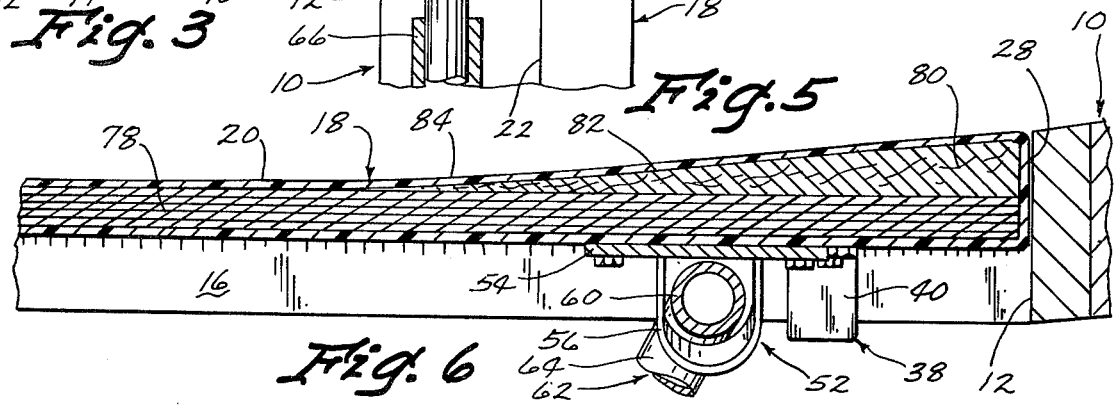
FIG. 6 is a sectional view taken along line 6—6 of FIG. 2.

Referring to FIG. 6, the cross section of the door is shown. The door comprises a plurality of planar members 78 joined together in laminated fashion. Mounted adjacent the lateral edges of planar members 78 on the interior face thereof are a pair of wedge members 80 which have arcuate surfaces presently inwardly so as to form a continuous arcuate surface 82. In covering relation over wedge members 80 and planar member 78 is a skin 84 formed from plastic, fiberglass, or other suitable material, and which provides a smooth continuous outer surface.

Thus, it can be seen that the device accomplishes at least all of its stated objectives. It permits the inward tilting of the door before swinging about a vertical axis. This makes the unsticking of the door from the opening easier inasmuch as it is merely necessary to push straight in, in order to release the door from the opening. Consequently, it improves the ease with which the door can be freed if stuck.

The door includes an inner arcuate surface which forms a continuation of the arc of the interior surface of the silo. It therefore minimizes the tendency to interfere with rotating augers or other equipment within the silo.

The device includes four types of movement, i.e., the tilting movement as shown in FIG. 3, the vertical sliding movement of sleeve 66, the pivoting movement about the axis provided by sleeve 66 and shaft 68, and the pivoting movement of the door about U-shaped cuffs 56, 58.

The rabbit grooves in the upper and lower edges of the door permit the doors to interlock in vertical alignment. While this is believed to be desirable in some applications, it can also be eliminated without detracting from the invention. The doors can be easily removed one at a time and they are shown to be durable, economical to manufacture, and simple in construction.

What is claimed is:

1. A silo door for a silo having cylindrical side walls, said silo walls having inner and outer cylindrical surfaces, said silo walls having at least one opening therein defined by upper and lower horizontal edges and spaced apart vertical side edges, said door comprising:

a door member having an inner face, an outer face, an upper edge, a lower edge, and opposite side edges, said door being sized to fit within said silo in covering relation over said opening with said outer face presented toward the exterior of said silo, hinge means movably connected to said silo for swinging movement about a vertical axis located adjacent one of said vertical side edges of said one opening, bracket means connecting said hinge means to said door member, said bracket means being adapted to permit limited inward tilting movement of said door with respect to said hinge means about a horizontal tilt axis;

latch means for selectively detachably securing said door member to said silo in covering relation over said opening.

2. A silo door according to claim 1 comprising at least one foot member connected to said door member and retentively engaging said lower horizontal edge of said opening, said foot member being manually movable out of retentive engagement with said lower edge by movement of said door member in a predetermined direction.

3. A silo door according to claim 2 wherein said latch means comprises a latch member movably mounted to said door member for movement from a latched position retentively engaging said upper horizontal edge of said opening to an unlatched position free from retentive engagement with said horizontal edge of said opening.

4. A silo door according to claim 1 wherein said bracket means comprises a first portion movably connected to said hinge means for permitting tilting movement of said door about said tilt axis, said bracket means having a second portion adapted to engage said hinge means for limiting tilting movement of said door member about said tilt axis beyond a predetermined point.

5. A side door according to claim 4 wherein said first portion of said bracket means is positioned below said second portion, said hinge means comprising a vertical member engaging both said first portion and said second portion.

6. A silo door according to claim 5 wherein said hinge means comprises at least one horizontal member connected at one end to said vertical member of said hinge means, a vertical hinge sleeve being connected to the other end of said horizontal member, a vertical hinge rod extending through said sleeve and being rigidly connected at its opposite ends to said silo.

7. A silo door according to claim 1 wherein said hinge means includes a first portion rigidly connected to said silo and a second portion movably connected to said first portion for pivotal movement about a vertical axis and for vertical movement along said vertical axis.

8. A silo door according to claim 1 wherein said inner surface of said door member is arcuate in cross section, said arcuate inner surface of said door member being aligned with and forming a continuation of said inner cylindrical surface of said silo whenever said door member is in covering relation over said opening, said outer surface of said door member being a flat plane.

9. A silo door according to claim 8 wherein said door member in cross section comprises at least one rigid planar member, a pair of wedge members secured to the opposite sides of one surface of said planar member as to form an arcuate surface of said one surface, and a skin surrounding said planar member and said wedge members.

10. A silo door according to claim 1 wherein a plurality alignment with one another, said openings being separated by a plurality of horizontal cross bars vertically spaced from one another, a plurality of door members identical to said first mentioned door member each being secured in covering relation over one of said openings by hinge means, bracket means and latch means identical in construction to said first mentioned hinge means, bracket means, and latch means, respectively.

11. A side door according to claim 10 wherein each of said door members comprise a rabbit groove on its upper edge and a reverse rabbit groove on its lower edge, said rabbit grooves of each one of said door members retentively engaging said reverse rabbit groove of the adjoining door members located immediately thereabove.

* * * * *